US009851671B2

(12) United States Patent
Parvin et al.

(10) Patent No.: US 9,851,671 B2
(45) Date of Patent: Dec. 26, 2017

(54) METHOD OF CONTROLLING A PRINTING PROCESS AND CONTROLLER THEREFOR

(71) Applicant: Hewlett-Packard Indigo B.V., Amstelveen (NL)

(72) Inventors: Noam Parvin, Nes Ziona (IL); Erez Kopel, Nes Ziona (IL); Idan Federman, Nes Ziona (IL); Gregory Braverman, Nes Ziona (IL); Moshe Birenboim, Nes Ziona (IL)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 15/114,808

(22) PCT Filed: Jan. 31, 2014

(86) PCT No.: PCT/EP2014/051882
§ 371 (c)(1),
(2) Date: Jul. 27, 2016

(87) PCT Pub. No.: WO2015/113615
PCT Pub. Date: Aug. 6, 2015

(65) Prior Publication Data
US 2016/0342122 A1 Nov. 24, 2016

(51) Int. Cl.
*G03G 15/06* (2006.01)
*G03G 15/00* (2006.01)
*G03G 15/10* (2006.01)

(52) U.S. Cl.
CPC ..... *G03G 15/5041* (2013.01); *G03G 15/065* (2013.01); *G03G 15/10* (2013.01); *G03G 15/50* (2013.01)

(58) Field of Classification Search
CPC ..... G03G 15/065; G03G 15/10; G03G 15/50; G03G 15/5041
See application file for complete search history.

(56) References Cited

U.S. PATENT DOCUMENTS

| | | | |
|---|---|---|---|
| 5,410,388 A | 4/1995 | Pacer et al. | |
| 7,421,223 B2 | 9/2008 | Jodra et al. | |
| 8,103,194 B2 | 1/2012 | Patton et al. | |
| 2012/0321329 A1 | 12/2012 | Yoshida | |
| 2013/0028621 A1* | 1/2013 | Furukawa | G03G 15/06 399/55 |

FOREIGN PATENT DOCUMENTS

| | | |
|---|---|---|
| EP | 0588347 | 3/1994 |
| EP | 1739505 | 1/2007 |
| EP | 2112560 | 10/2009 |
| WO | WO-2013107523 | 7/2013 |

OTHER PUBLICATIONS

Bhattacharyya, M. et al., "Ink Density Profile on Indigo Developer Roller", Journal of Imaging Science and Technology, vol. 53, No. 4, Jul. 2009, pp. 41201-1-41201-6(6).

* cited by examiner

*Primary Examiner* — Hoang Ngo
(74) *Attorney, Agent, or Firm* — HP Inc. Patent Department

(57) ABSTRACT

An example method of controlling a printing process in accordance with aspects of the present disclosure includes controlling an optical density of a printed image such that the optical density is increased for a predetermined portion of a leading edge of a page.

14 Claims, 3 Drawing Sheets

METHOD OF CONTROLLING A PRINTING PROCESS AND CONTROLLER THEREFOR

BACKGROUND

Variations in the amount of ink applied to media can produce noticeable variations across a page, in particular, but not exclusively between the trailing edge of one page and the leading edge of the next.

BRIEF DESCRIPTION OF DRAWINGS

For a more complete understanding, reference is now made to the following description taken in conjunction with the accompanying drawings in which.

DETAILED DESCRIPTION

In a printing system, for example a printing system including a controller for voltage-controlling ink density, one or more of several developer voltages in the printing system can be adjusted to control a printing process such that a single printing station corresponding to a particular ink can print both standard and lighter versions of a color from the same ink source. In an implementation, a developer voltage for the printing station can be decreased such that fewer ink particles separate from the ink and a thinner layer, or less of a concentration, of the ink is transferred to appear lighter in color when printed as an image on a print media. Conversely, the developer voltage for the printing station can be increased such that more ink particles separate from the ink and a thicker layer, or more of a concentration, of the ink is transferred to appear darker in color when printed as an image on the print media.

Although the thickness of the ink layer, on each transfer and on the substrate is designed to be fixed, due to mechanical and physical characteristics of the printing system, the thickness of the ink layer does not remain constant across a page. As a result, the optical density (OD) of the printed ink of the image is non-uniform. In order to compensate for those changes in OD, the controller of the printing system controls the thickness of the ink layer that is printed on the substrate.

Although the controller may be implemented in various printing systems, voltage-controlled ink density is described with reference to the following printing environment.

Figure 1:
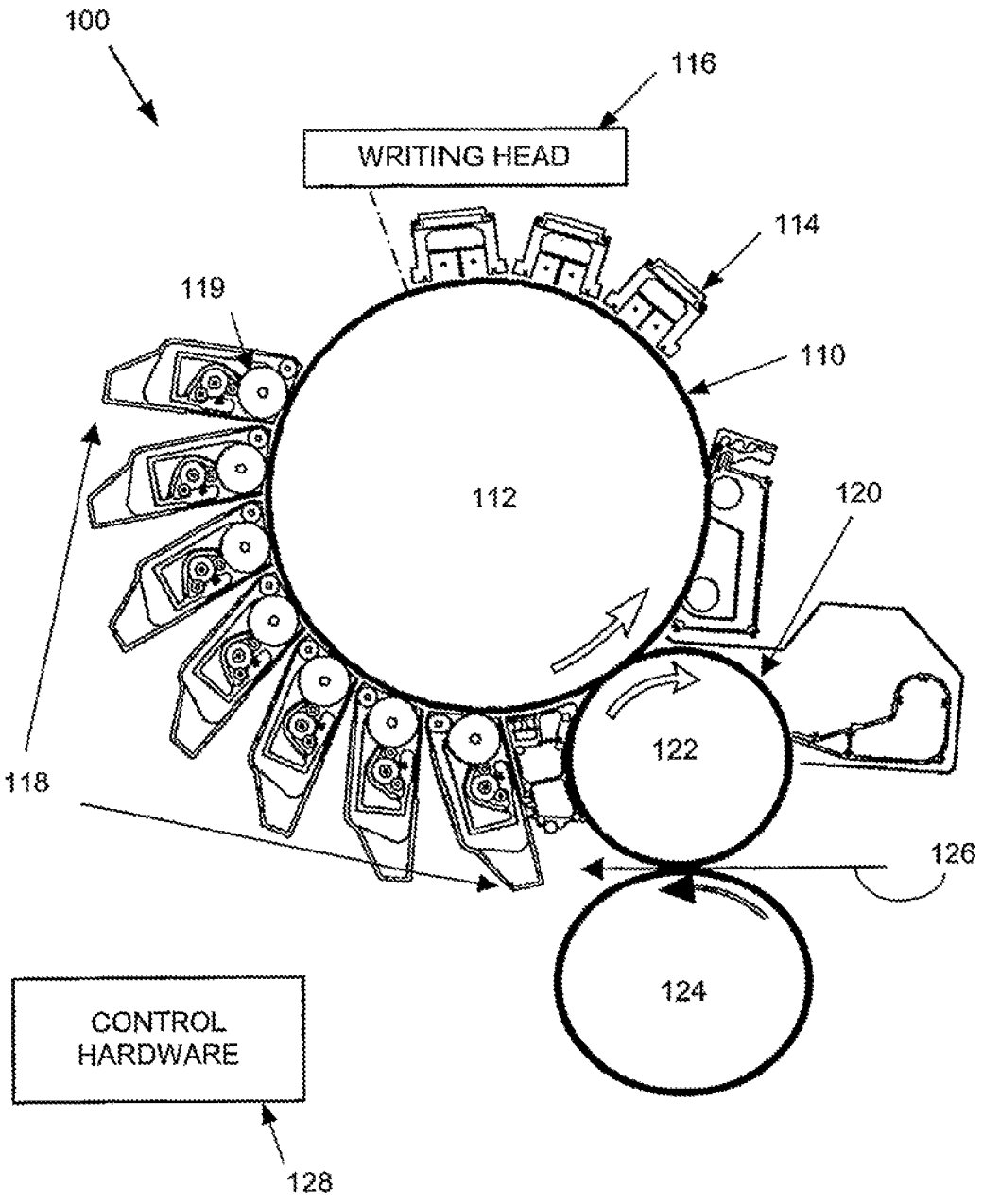
FIG. 1 illustrates various components of an exemplary printing system including an example of a controller for controlling a printing process.

Reference is made to FIG. 1, which illustrates an exemplary digital printing press 100. The digital printing press 100 includes a Photo Imaging Plate (PIP) foil 110 wrapped around a PIP drum 112, and a plurality of Binary Ink Development (BID) units 118 disposed about the PIP drum 112. The PIP foil 110 includes photoconductive material.

Each BID unit 118 contains a single ink, but the different BID units 118 may contain inks of different colors. For example, the seven BID units 118 of FIG. 1 contain a total of seven different inks.

The digital printing press 100 may produce a print as follows. The PIP foil 110 is charged by a Scorotron assembly 114. As the PIP drum 112 is rotated, a writing head 116 produces a laser beam that discharges specific areas on the PIP foil 110. These discharged areas define a latent image.

One BID unit 118 applies ink to the PIP foil 110 during each rotation of the PIP drum 112. A BID unit 118 is moved near the PIP foil 110. The BID unit 118 includes a developer roller 119, which is charged to a lower potential than the charged areas on the PIP foil 110, and a larger potential than the discharged areas on the PIP foil no. Charged ink in the BID unit 118 is attracted to the discharged areas on the foil 110. Dots of the ink are transferred from the developer roller 119 to the discharged areas. Ink is not transferred to those foil areas having higher potential than the developer roller 119. In this manner, ink is deposited on the PIP foil 110. As the PIP drum 112 is rotated, a color plane of the image is formed on the PIP foil 110.

With each additional rotation of the PIP drum 112, the writing head 116 discharges specific areas on the PIP foil 110, and another BID unit 118 applies ink to the discharged areas. In this manner, a developed image is formed on the PIP foil 110.

The developed image is transferred from the PIP foil 110 to a blanket 120, which is wrapped around an Intermediate Transfer Member (ITM) 122. The transfer of the developed image is achieved through electrical and mechanical forces. The blanket 120 is charged and heated to raise the temperature of the ink on the blanket 120. The increase in temperature causes the ink to swell and acquire a gelatin-like form. With the help of another drum 124, the developed image is transferred from the blanket 120 to a substrate 126 (i.e., a print medium).

Various parameters such as ink density, ink conductivity, ink temperature, ink separation, imaging oil temperature, imaging oil dirtiness, ITM temperature, and ITM blanket counter (a measure of blanket age or usage, such as a number of impressions made by the blanket 120 since it was installed), corona voltage (the voltage of the corona in the Scorotron assembly 114), grid voltage (the voltage of a grid in the Scorotron 114 assembly), and vlight/vbackground (the voltage on the PIP foil 110 after/before the PIP foil 110 is discharged) and developer voltage are used to control the digital printing press 110. Control hardware 128 of the digital printing press sets target values for the control parameters, and maintains the control parameters at or near their target values. These target values may be predetermined and defined by a print profile.

For the printing system of FIG. 1, the developer voltage, which is applied to the developer roller 119 inside the MD unit 118, controls the thickness of the ink dots that are deposited on the discharged areas of the PIP foil 110. Increasing the developer voltage increases the thickness of the ink dots. In other types of printing system, the ink thickness may be controlled by adjusting other control parameters, for example, ink viscosity.

Figure 2A:
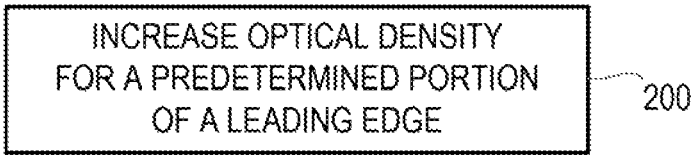
FIG. 2*a* is a flow diagram that illustrates an example of a method for controlling a printing process.

Color variations between the trailing edge of one page and leading edge of the next page may occur. This is caused by a lower OD on the first part of each page, for example, the few centimeters of each page, compared to the rest of the image. It would appear that after this point, the CD becomes stable and color variations for the remainder of the page do not occur. For web printing system, where the print media is provided by a continuous web of material and the print is produced in sequence, without any gap between pages, the color change is visible. This may be achieved by a method of controlling the printing process as illustrated in FIG. 2*a*.

Figure 2B:
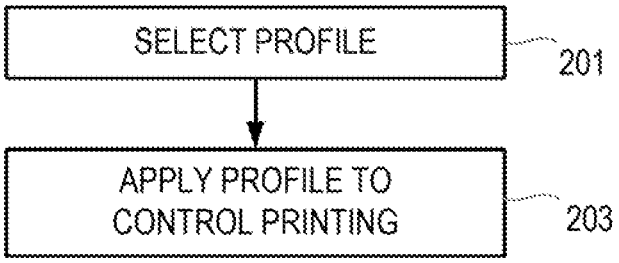
FIG. 2*b* is a flow diagram that illustrates, in more detail, the example of FIG. 2*a*.

An optical density of a printed image is increased, 200, for a predetermined portion of a leading edge of a page to compensate for the lower OD on the leading edge and equal it to the same level of the rest of the image. For example, as shown in FIG. 2*b*, a profile is selected, 201, and applied, 203, to control the printing process.

In the system of FIG. 1, for example, this may be achieved by adjusting at least one control parameter, for example, varying the BID's developer roller voltage, in order to vary the ink thickness and hence the OD. The developer roller is one of the main subsystems that controls the ink thickness of the system of FIG. 1 and thus has an impact on color OD. The developer voltage is set during each Color Adjust calibration to provide a default developer voltage (default parameter value). This default developer voltage is set and used to print a page. For a predetermined portion of the page at the leading edge of the page, the default developer voltage is altered by adding a corrective developer voltage, á (corrective value). The corrective developer voltage, á, is applied on the default developer voltage for a predetermined portion of the leading edge of each page, and then the voltage returns to the default developer voltage set by the color adjust for the remainder of the page. Therefore, a profile is selected which alters the OD on the problematic area up to the point where the OD becomes stable and the default developer voltage alone can be applied.

The software infrastructure is very flexible. A profile for the developer voltage is created. The profile, for example, may be built using up to 16 bars, that is, 16 different set points along the page, each set point has its own developer voltage and period. If the developer voltage of one bar is lower than the previous bar, the profile generates a slope for a gradual change in the developer voltage. Therefore, as the developer voltage returns to its lower, default developer voltage, that is, the corrective developer voltage is no longer applied, the profile provides a gradual decrease in the developer voltage from its current value (for example the default value plus the corrective value) to the final default value, so that there is no sudden voltage drop and no sudden change in ink thickness and hence no sudden change in OD.

The color correction for the leading edge is achieved using pre-defined profiles. For example, 5 pre-defined profiles, each profile setting a corrective developer voltage to be added to the default developer voltage, and then return to the default developer voltage may be used. For example, a first, no-correction profile, á=0v; a second, low profile, á=5v; a third, medium profile, á=8v; a fourth, high profile, á=11v; and a fifth, rough profile, á=14v.

The 5 examples above are for illustrative purposes and it can be appreciated that any number of pre-defined profiles may be provided having different corrective developer voltages.

The profile may be selected by the user following color variations or, alternatively, it may be selected automatically based on OD measurements taken of the previously printed page.

Figure 3:
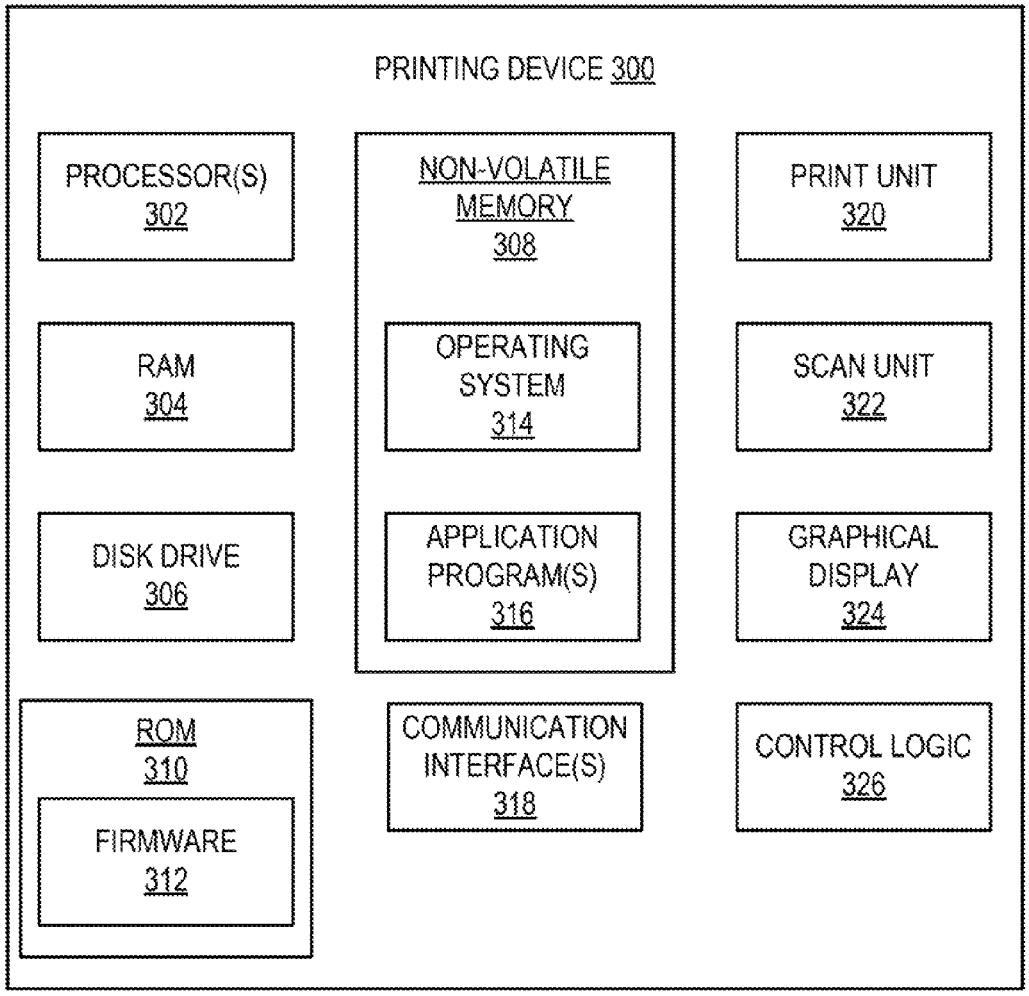
FIG. 3 illustrates various components of an exemplary printing device in which the printing system of FIG. 1 can be implemented.

FIG. 3 illustrates various components of an exemplary printing device 300 in which the printing system of FIG. 1 can be implemented. As used herein, "printing device" means any electronic device having data communications, data storage capabilities, and/or functions to render printed characters, text, graphics, and/or images on a print media. A printing device may be a printer, fax machine, copier, plotter, and the like. The term "printer" includes any type of printing device using a transferred imaging medium, such as ink, to create an image on a print media. Examples of such a printer can include, but are not limited to inkjet printers, electrophotographic printers, plotters, portable printing devices, as well as all-in-one, multi-function combination devices.

Printing device 300 may include one or more processors 302 (e.g., any of microprocessors, controllers, and the like) which process various instructions to control the operation of printing device 300 and to communicate with other electronic and computing devices. Printing device 300 can be implemented with one or more memory components, examples of which include random access memory (RAM) 304, a disk drive 306, and non-volatile memory 308 (e.g., any one or more of a ROM 310, flash memory, EPROM, EEPROM, etc.).

The one or more memory components store various information and/or data such as configuration information, print job information and data digital print data, graphical user interface information, fonts, templates, menu structure information, and any other types of information and data related to operational aspects of printing device 300. Printing device 300 may also include a firmware component 312 that is implemented as a permanent memory module stored on ROM 310, or with other components in printing device 300, such as a component of a processor 302. Firmware 312 is programmed and distributed with printing device 300 to coordinate operations of the hardware within printing device 300 and contains programming constructs used to perform such operations.

An operating system 314 and one or more application programs 316 can be stored in non-volatile memory 308 and executed on processor(s) 302 to provide a runtime environment. Further, application programs 316 can facilitate user interface display and interaction, printing, scanning, and/or any number of other operations of printing device 300. A user interface allows a user of printing device 300 to navigate a menu structure with any of indicators or a series of buttons, switches, or other selectable controls that are manipulated by a user of the printing device.

Printing device 300 further includes one or more communication interfaces 318 which can be implemented as any one or more of a serial and/or parallel interface, a wireless interface, any type of network interface, and as any other type of communication interface. A wireless interface enables printing device 300 to receive control input commands and other information from an input device, such as from an infrared (IR), 802.11, Bluetooth, or similar RF input device. A network interface provides a connection between printing device 300 and a data communication network which allows other electronic and computing devices coupled to a common data communication network to send print jobs, menu data, and other information to printing device 300 via the network. Similarly, a serial and/or parallel interface provides a data communication path directly between printing device 300 and another electronic or computing device.

Printing device 300 also includes a print unit 320 that includes mechanisms selectively applying an imaging medium such as ink (e.g., liquid toner), and the like to a print media in accordance with print data corresponding to a print job. The print media can include any form of media used for printing such as paper, card stock, plastic, fabric, Mylar, transparencies, film, metal, and the like, and different sizes and types such as 8½*11, A4, roll feed media, etc.

Printing device 300, when implemented as an all-in-one device for example, can also include a scan unit 322 that can be implemented as an optical scanner to produce machine-readable image data signals that are representative of a scanned image, such as a photograph or a page of printed text. The image data signals produced by scan unit 322 can be used to reproduce the scanned image on a display device or with a printing device. Printing device 300 may also include a graphical display 324 that provides information regarding the status of printing device 300 and the current options available to a user through the menu structure.

Although shown separately, some of the components of printing device 300 can be implemented in an application specific integrated circuit (ASIC). Additionally, a system bus (not shown) typically connects the various components within printing device 300. A system bus can be implemented as one or more of any of several types of bus structures, including a memory bus or memory controller, a peripheral bus, an accelerated graphics port, or a local bus using any of a variety of bus architectures. Printing device 300 may also include any form of control logic 326 which refers to hardware, firmware, software, or any combination thereof that may be implemented to perform the logical operations associated with a particular function or with the operability of the printing device 300. Logic 326 may also include any supporting circuitry is utilized to complete a given task including supportive non-logical operations.

Prior to printing, the default developer voltage for each BID unit 118 is derived or predetermined and stored by the ROM 310 and this default developer voltage is provided to the processor(s) 302. A plurality of pre-defined profiles are stored in the ROM 310, or alternatively, the RAM 304, or disk within the disk drive 306 or flash memory or the like and have a corrective developer voltage á, for example, the profiles mentioned above. A profile is selected, 201, and applied, 203, to control; the printing process of the print unit 320. The developer voltage defined by the selected profile defines the ink thickness such that for a predetermined portion of the leading edge of the page is greater than the thickness of the ink for the remainder of the page.

As the PIP drum 112 is rotated, the writing head 116 discharges areas on the PIP foil 110 and, while being controlled at the developer voltage provided by the selected profile, the BID unit 118 deposits dots on the substrate at a desired thickness.

Although implementations of printing systems have been described in language specific to structural features and/or methods, it is to be understood that the subject of the appended claims is not necessarily limited to the specific features or methods described. Rather, the specific features and methods are disclosed as exemplary implementations of printing systems.

Although various examples have been illustrated in the accompanying drawings and described in the foregoing detailed description, it should be understood that the disclosure is not limited to the examples disclosed, but is capable of numerous modifications without departing from the scope of the disclosure as set out in the following claims.

The invention claimed is:

1. A method of controlling a printing process, the method comprising:

increasing an optical density of a printed image for a predetermined portion of a leading edge of a page, including increasing a voltage applied to a developer roller of a printing device from a default developer voltage to an increased developer voltage higher than the default developer voltage, during the predetermined portion of the leading edge of the page; and after the predetermined portion of the leading edge of the page, returning the voltage applied to the developer roller to the default developer voltage.

2. The method of claim 1, wherein increasing the optical density further includes increasing ink viscosity.

3. The method of claim 1, wherein increasing the voltage applied to the developer roller from the default developer voltage to the increased developer voltage comprises:

adding a corrective voltage value to the default voltage for the predetermined portion of the leading edge of the page.

4. The method of claim 3, wherein adding a corrective voltage value comprises:

selecting one of a plurality of pre-defined profiles each profile defining a corrective value to be added to the default voltage.

5. The method of claim 2, wherein increasing the ink viscosity is to increase a thickness of ink dispensed from a binary ink development unit to print the image for the predetermined portion of the leading edge of the page.

6. The method of claim 1, further comprising:

creating a profile having a plurality of levels corresponding to different voltages applied to the developer roller;

setting one of the plurality of levels in the profile to a level corresponding to the default developer voltage;

increasing the voltage applied to the developer roller to the increased developer voltage by gradually increasing the setting in the profile, one level at a time, from the level corresponding to the default developer voltage to a level corresponding to the increased developer voltage; and returning the voltage applied to the developer roller to the default developer voltage by gradually decreasing the setting in the profile, one level at a time, from the level corresponding to the increased developer voltage to the level corresponding to the default developer voltage.

7. A controller for controlling a printing process of a printing device, the controller comprising:

a processor to:

increase an optical density of a printed image for a predetermined portion of a leading edge of a page, by increasing a voltage applied to a developer roller of the printing device from a default developer voltage to an increased developer voltage higher than the default developer voltage, during the predetermined portion of the leading edge of the page; and after the predetermined portion of the leading edge of the page, return the voltage applied to the developer roller to the default developer voltage.

8. The controller of claim 7, wherein, in addition to increasing the voltage applied to the developer roller, the processor is further to control another parameter to increase a thickness of ink dots for the predetermined portion of the leading edge of the page.

9. The controller of claim 7, wherein, to increase the voltage applied to the developer roller, the processor is to add a corrective voltage value to the default developer voltage for the predetermined portion of the leading edge of the page.

10. The controller of claim 7, further comprising:

a storage device to store a plurality of pre-defined profiles, each profile defining a level of the voltage applied to the developer roller, and the controller selects one of the plurality of pre-defined profiles corresponding to the default developer voltage.

11. The controller of claim 8, wherein the processor is to increase ink viscosity to increase the thickness of the ink dots deposited to print the image.

12. A non-transitory computer readable medium storing instructions that when executed by a processor cause the processor to:

increase an optical density of a printed image for a predetermined portion of a leading edge of a page, by increasing a voltage applied to a developer roller of a printing device from a default developer voltage to an increased developer voltage higher than the default developer voltage, during the predetermined portion of the leading edge of the page; and after the predetermined portion of the leading edge of the page, return the voltage applied to the developer roller to the default developer voltage.

13. The non-transitory computer readable medium of claim 12, wherein, to increase the voltage applied to the developer roller, the processor is to add a corrective voltage value to the default developer voltage for the predetermined portion of the leading edge of the page to increase the optical density for the predetermined portion of the leading edge of the page.

14. The non-transitory computer readable medium of claim 12, wherein the instructions are to cause the processor to:

create a profile having a plurality of levels corresponding to different voltages applied to the developer roller;

set one of the plurality of levels in the profile to a level corresponding to the default developer voltage;

increase the voltage applied to the developer roller by gradually increasing the setting in the profile, one level at a time, from the level corresponding to the default developer voltage to a level corresponding to the increased developer voltage; and return the voltage applied to the developer roller to the default developer voltage by gradually decreasing the setting in the profile, one level at a time, from the level corresponding to the increased developer voltage to the level corresponding to the default developer voltage.

* * * * *